United States Patent [19]

Rooney

[11] 4,189,141

[45] Feb. 19, 1980

[54] MASK FOR EXERCISING FACIAL MUSCLES

[76] Inventor: Kenneth R. Rooney, 1248 Schenectady Ave., Brooklyn, N.Y. 11203

[21] Appl. No.: 846,115

[22] Filed: Oct. 27, 1977

[51] Int. Cl.[2] ..... A63B 23/00

[52] U.S. Cl. ..... 272/95; 128/76 B; 172/119

[58] Field of Search ..... 272/95, 119; 128/76 R, 128/76 B, 163

[56] References Cited

U.S. PATENT DOCUMENTS

| | | | |
|---|---|---|---|
| D. 235,789 | 7/1975 | Eberhardt | 272/95 |
| 2,002,449 | 5/1935 | Dohm | 128/76 B |
| 2,134,640 | 10/1938 | Merkin | 128/163 |
| 2,671,446 | 3/1954 | Mann | 128/76 R |
| 2,728,339 | 12/1955 | Elmhirst | 128/76 R |
| 2,882,892 | 4/1959 | Kosior | 272/95 |
| 3,211,146 | 10/1965 | Rodelli | 128/76 R |
| 3,507,493 | 4/1970 | Robins | 272/95 |
| 3,540,440 | 11/1970 | Andreas | 128/76 B |

FOREIGN PATENT DOCUMENTS

| | | | |
|---|---|---|---|
| 467523 | 3/1914 | France | 128/163 |

*Primary Examiner*—Richard J. Johnson

[57] ABSTRACT

A facial exercise mask includes an externally convex mask body made of an elastic two-way stretch cloth material. A central face portion has holes for eyes, nose and mouth of the wearer. Massive lead or omnium weights are enclosed in pockets secured inside the mask at b row, temple, cheek, nose and chin portions. A sanitary, flexible removable liner may be inserted inside the mask body. The mask body may be held in place by separate, adjustable head and chin straps, or by a single wide elastic strap engaging the back of the wearer's head.

8 Claims, 8 Drawing Figures

FIG. 1
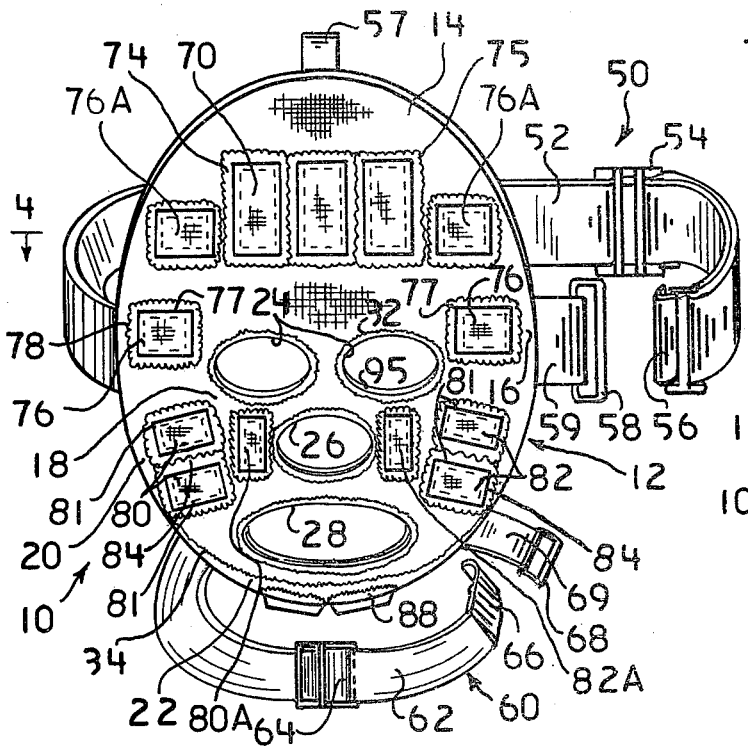
FIG. 2
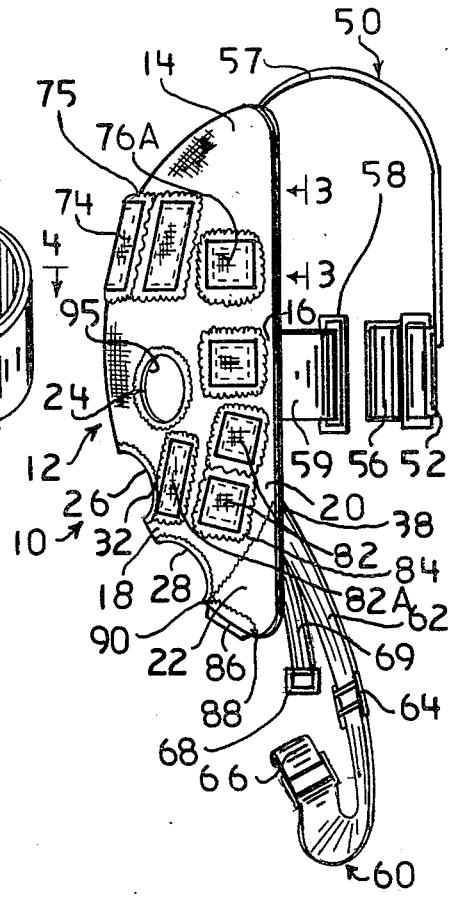
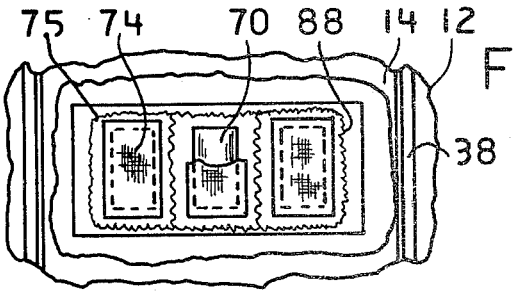
FIG. 3
FIG. 4
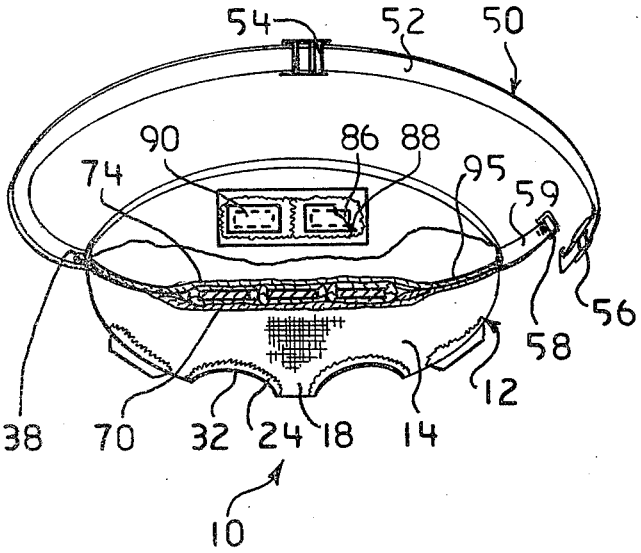

MASK FOR EXERCISING FACIAL MUSCLES

This invention concerns a facial exercise mask and more specifically concerns a facial exercise mask for use in conjunction with appropriate exercises to improve the tonus or tonicity of the facial muscles.

It has been long known that the tonus of facial muscles may be improved by exercise practised over a long period of time. The present invention is intended to reduce the time required to achieve good muscle tonicity when used in a systematic way with appropriate exercises. The facial mask serves as a resistive or reactive appliance to increase the effectiveness of the exercises. Facial masks have long been used for various purposes, but none heretofore has been constructed in such manner that it will improve the effectiveness of prescribed facial exercises when worn during performance of the exercises.

According to the invention there is provided a mask including a mask body which covers the entire face, brow and chin which may be lined by a removable disposable paper or cloth liner. The mask body is held in place by head and chin straps or by a single wide separate headband and is made of elastic two-way stretch cloth material.

Pockets sewn in the material contain lead or omnium weights which in conjunction with the stretchability of the mask vigorously work out the facial muscles when they are exercised.

It is therefore a principal object of the present invention to provide a facial mask covering the entire face, brow and chin, made of elastic woven cloth material, with suitably distributed weights mounted thereon for improving the effectiveness of facial muscle exercises.

Another object of the present invention is to provide a mask as described fitted with strap means for holding the mask in place while in use.

A further object of the present invention is to provide a mask as described with a removable, sanitary liner.

These and other objects and many of the attendant advantages of this invention will be readily appreciated as the same becomes better understood by reference to the following detailed description when considered in connection with the accompanying drawings in which:

FIG. 1 is a front, oblique view of a facial exercise mask embodying the present invention;

FIG. 2 is a side elevational view taken along line 2—2 of FIG. 1;

FIG. 3 is a fragmentary rear elevational view taken along line 3—3 of FIG. 3 portions of the inner liner being removed;

FIG. 4 is a horizontal cross-sectional view taken along line 4—4 of FIG. 1;

DETAILED DESCRIPTION OF THE PREFERRED EMBODIMENT

Figure 5:
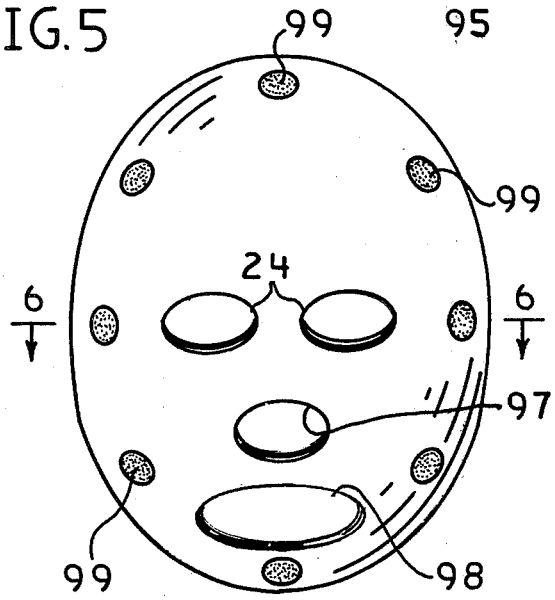
FIG. 5 is a front elevational view of the inner, removable liner of the mask.

Referring now to the drawings wherein like reference characters designate like or corresponding parts throughout, there is illustrated in FIGS. 1-4, a facial mask generally designated as reference numeral 10, having an elastic woven cloth body 12 shaped to fit the entire face of a person using it for facial muscle exercise purposes. The mask is externally convex and due to its elasticity will fit snugly against and conform to the shape of the person's brow at an upper portion 14, to the temples at an upper side portion 16, to the face at a central portion 18, to the cheeks at each of the lower side portions 20, and to the chin at a bottom portion 22. In the central portion 18 are formed two holes 24 which will surround the wearer's eyes, a lower hole 26 through which the wearer's nose will extend, and a lowermost hole 28 whose elastic rim surrounds the wearer's mouth. The rims of all holes are reinforced by a stitching 32. The bottom or chin portion 22 may be a separate panel secured to the upper body portion of the mask by a stitching 34. Alternatively, the entire body 12 may be woven as a single, one piece unit. An elastic binding 38 is sewn all around the rim of the body 12 to prevent unraveling of the elastic cloth material.

A head strap assembly generally designated as reference numeral 50 is provided to hold the mask snugly on the head of the wearer. This assembly includes a strap 52 secured to one edge of the body 12 at the temple portion 16. The strap 52 which has a buckle 54 for adjusting the length thereof, has a hook 56 at the end which may be engaged on an eye or ring 58 secured to the outer end of a short strap 59 attached to the body 12 at the opposite edge of the temple portion. A narrower central strap 57 which overlays the top of the wearer's head is secured between the upper edge of the body 12 and the wider strap 52.

A chin assembly generally designated as reference numeral 60 includes a strap 62 secured to one lateral edge of the bottom chin portion 22 and has a buckle 64 for adjusting the length of the strap which terminates in a hook 66 adapted to engage on an eye or ring 68 secured to the outer end of a short strap 69 attached to the opposite lateral edge of the chin portion 22.

Three thick rectangular metal weights 70 are enclosed in respective elastic cloth pockets 74 defined by a stitching 75 at the inner side of the body 12; at the brow portion 14. Lateral weights 76, 76A are located in pockets 77 secured by stitching 78 at each side of the temple portion 16 inside the body 12. Lateral weights 76A are on each side above the temple area. A pair of weights 80, 80A and 82, 82A are located in respective pockets 81 at each side of the cheek portion 20 and secured by a stitching 84. Weights 80A and 82A are located on either side of the nose portion. A pair of weights 86 are secured by a stitching 88 in respective pockets 90 inside the chin portion 22. The weights may be massive lead or omnium metal plates each approximately three quarters of an inch wide and one and a quarter inches long, except for the nose which are half. The weights of course may have other shapes such as oval, circular and the like. The pockets enclosing the weights may also be made of elastic, two-way stretch material.

Figure 6:
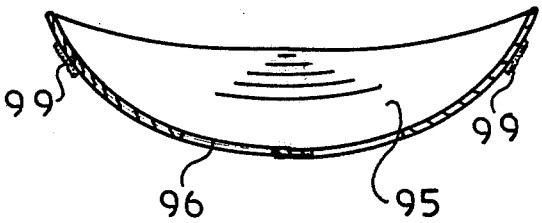
FIG. 6 is a cross-sectional view taken along line 6—6 of FIG. 5.

A removable sanitary liner 95 for the mask is shown in FIGS. 5 and 6. This liner can be made of disposable paper or washable cloth or flexible, sheet plastic material. The liner is externally convex and has eyeholes 96, nosehole 97 and a mouth hole 98 all registering with holes 24, 26 and 28 in the body 12. The liner may be loose, or if desired may be provided with pressure sensitive adhesive portions 99 to stick to the inside of the body. In any case the liner is readily removable when desired.

Figure 7:
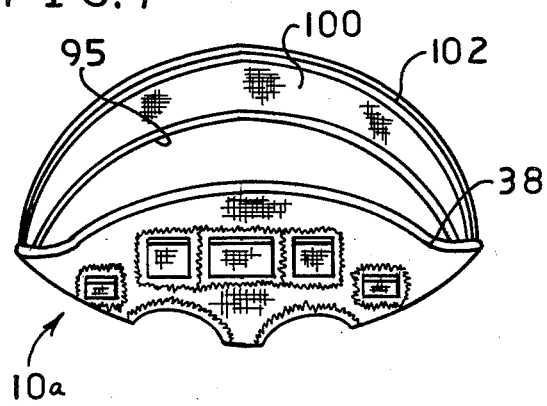
FIG. 7 is a top plan view of another embodiment of a facial exercise mask.
Figure 8:
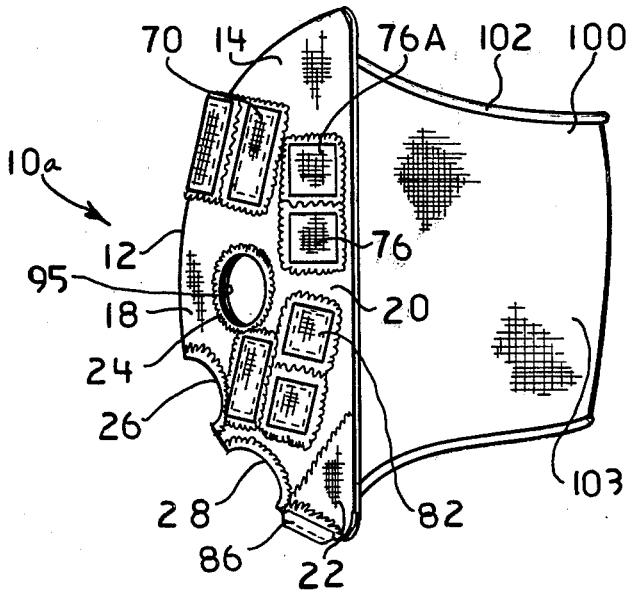
FIG. 8 is a side elevational view of the mask of FIG. 7.

It is possible to replace the individual straps shown in FIGS. 1, 2 and 4 by a single headband or strap 100 shown by a mask generally designated by reference numeral 10A in FIGS. 7 and 8. The mask body 12 includes the chin portion 22 which is the same as in the mask 10. In addition, the flat metal weights, holes and stitching are the same. The single strap 100 is a wide elastic band made of two-way stretch material, finished with edge bindings 102, 104. The band extends from the brow portion 14 down to the chin portion 22. It is slightly narrower at the back 103 so that it covers the entire back of the wearer's head in a snug, close fitting manner.

In use the mask will be mounted in place on the wearer's face by means of either the separate straps 52, 62 or the single wide strap 100. The following are several exercises which may be performed while wearing the mask.

1. Brow Muscle—The eyebrows are raised vertically upward as far as possible, to contract this muscle. Then the eyebrows are lowered to relax this muscle.

2. Eyebrow Muscles—The eyebrows are contracted horizontally toward the nose as far and as hard as possible. Then the muscles are relaxed moving the eyebrows apart.

3. Eye Muscles—The eyelids are closed as hard as possible and then relaxed.

4. Upper and Lower Nose Muscles—Contract these muscles by wrinkling the nose and curling the upper lip upwardly.

5. Upper and Lower Lip Muscles—Contract these muscles by puckering them, then turning lips inwardly and pressing tightly.

6. Mouth and Lower Lip Muscles—Contract these muscles by clenching teeth, pucker lips and smiling tensely.

7. Jaw and Chin Muscles—Force corners of mouth and lower jaw forward as hard as possible; also perform chewing motion as quickly as possible for about a half minute, opening the mouth as wide as possible.

Other exercises can be prescribed. The list above is only exemplary of the types of exercises which may be performed. The elastic mask will resist expansion movement of the facial parts and muscles. The massive weights will apply pressure and weight the muscles to require greater muscular effort. Furthermore, the mask and weights will exert a massaging effect which will increase blood circulation and improve oxygen supply and aid in muscle tonicity.

When the mask is used consistently in a planned program of exercises, the facial complexion will improve and youthful appearance will be enhanced because if a muscle is in a state of (tonus) partial contraction in which is characteristic of a normal muscle, it is fair to say you have also improved its strength, plus tighten the muscles over the bone, therefore lessening the severity of the linear and sag definition in the face; greater muscle tonicity.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A method of improving the tonicity of facial muscles using a facial exercise mask, comprising the steps of:

providing a facial exercise mask comprising an externally convex, elastic two-way stretch cloth body shaped to fit a wearer's face, said body having an upper brow portion, an upper side temple portion, a lateral cheek portion, a central face portion, and a bottom chin portion, said central face portion being formed with a pair of eyeholes, a lower nosehole and a lowermost mouth-hole; massive plate weight means mounted within said body at certain of said portions, the massive weight means being at said brow portion, above said temple portion, at said temple portion, at said cheek portion, at said chin portion, and near said nosehole, said weights in conjunction with the stretchability of the mask providing resistance to movement of the muscles during performance of exercises; and attachment means for securing said mask body in place in snug juxtapostion to a wearer's face;

securing said mask to the face in snug conforming juxtaposition thereto;

selecting groups of facial muscles to be exercised; and systematically exercising said selected groups of facial muscles with said weights in conjunction with the stretchability of the mask resisting movement of said facial muscles thereby requiring greater muscular effort than exercising with the mask.

2. A method as described in claim 1 including the steps of:

raising the eybrows as far as possible, then lowering the eyebrows;

contracting the eybrows towards the nose as far as possible, then relaxing the eyebrows;

closing the eyelids as far as possible and then relaxing;

wrinkling the nose and curling the upper lip upwardly;

puckering the lips, then turning the lips inwardly and pressing tightly; and clenching the teeth, puckering the lips, and smiling tensely.

3. A method as described in claim 1 including the step of raising the eyebrows as far as possible, then lowering the eyebrows.

4. A method as described in claim 1 including the step of contracting the eyebrows towards the nose as far as possible, then relaxing the eyebrows.

5. A method as described in claim 1 including the step of closing the eyelids as far as possible and then relaxing.

6. A method as described in claim 1 including the step of wrinkling the nose and curling the upper lip upwardly.

7. A method as described in claim 1 including the step of puckering the lips, then turning the lips inwardly and pressing tightly.

8. A method as described in claim 1 including the step of clenching the teeth, puckering the lips, and smiling tensely.

* * * * *